US010047442B2

(12) United States Patent
Wang et al.

(10) Patent No.: US 10,047,442 B2
(45) Date of Patent: Aug. 14, 2018

(54) SURFACE ALLOY COATING COMPOSITE MATERIAL USED FOR HIGH TEMPERATURE RESISTANT MATERIAL, COATING AND PREPARATION METHOD THEREOF

(71) Applicant: Institute of Metal Research, Chinese Academy of Sciences, Shenyang (CN)

(72) Inventors: Fuhui Wang, Shenyang (CN); Shenglong Zhu, Shenyang (CN); Minghui Chen, Shenyang (CN); Mingli Shen, Shenyang (CN); Cheng Wang, Shenyang (CN)

( * ) Notice: Subject to any disclaimer, the term of this patent is extended or adjusted under 35 U.S.C. 154(b) by 335 days.

(21) Appl. No.: 14/896,767

(22) PCT Filed: Oct. 16, 2013

(86) PCT No.: PCT/CN2013/001260

§ 371 (c)(1),
(2) Date: Dec. 8, 2015

(87) PCT Pub. No.: WO2015/035542

PCT Pub. Date: Mar. 19, 2015

(65) Prior Publication Data

US 2016/0122877 A1 May 5, 2016

(30) Foreign Application Priority Data

Sep. 13, 2013 (CN) ..... 2013 1 0419123

(51) Int. Cl.
*C23C 24/08* (2006.01)
*C23C 4/02* (2006.01)
(Continued)

(52) U.S. Cl.
CPC ..... *C23C 24/085* (2013.01); *B22F 1/0003* (2013.01); *B22F 9/04* (2013.01);
(Continued)

(58) Field of Classification Search
CPC ... C22C 19/056; C22C 19/058; C23C 28/324; C23C 28/345; C23C 24/085
See application file for complete search history.

(56) References Cited

U.S. PATENT DOCUMENTS 8,697,250 B1 * 4/2014 Jarosinski ..... F01D 5/288 420/437
2004/0244676 A1 * 12/2004 Schnell ..... C23C 24/10 117/95

(Continued)

FOREIGN PATENT DOCUMENTS

CN 101109086 A 1/2008

*Primary Examiner* — Xiao Si Zhao
(74) *Attorney, Agent, or Firm* — Tsz Lung Yeung

(57) ABSTRACT

The present invention provides a surface alloy coating composite material for a high temperature resistant material, a coating and a manufacturing method thereof, wherein the surface alloy coating composite material is made of metal alloy powder having a face-centered cubic structure and enamel powder, and a component percentage thereof is as follows: 10-70 wt % is the metal alloy powder, and remaining is the enamel powder; the metal alloy powder is selected from at least one type of NiCrAlX, NiCrX and NiCoCrAlX, wherein X is at least one type of hafnium, zirconium, a rare earth element and mixed rare earth, and the mixed rare earth can be two types or more than two types of rare earth elements that are used together or a rare earth element and one type or multiple types of Na, K, Ca, Sr and Ba that are used in a combined way.

4 Claims, 4 Drawing Sheets

(51) Int. Cl.

| | |
|---|---|
| ***C23C 4/18*** | (2006.01) |
| ***C23C 28/00*** | (2006.01) |
| ***B22F 1/00*** | (2006.01) |
| ***B22F 9/04*** | (2006.01) |
| ***C22C 19/05*** | (2006.01) |
| ***C22C 30/00*** | (2006.01) |
| ***C22F 1/10*** | (2006.01) |

(52) U.S. Cl.

CPC ..... *C22C 19/056* (2013.01); *C22C 19/058* (2013.01); *C22C 30/00* (2013.01); *C22F 1/10* (2013.01); *C23C 4/02* (2013.01); *C23C 4/18* (2013.01); *C23C 28/324* (2013.01); *C23C 28/345* (2013.01); *B22F 2009/041* (2013.01); *B22F 2301/15* (2013.01); *B22F 2302/20* (2013.01); *B22F 2302/25* (2013.01); *B22F 2302/253* (2013.01); *B22F 2302/256* (2013.01); *B22F 2302/45* (2013.01); *B22F 2303/05* (2013.01); *B22F 2303/30* (2013.01)

(56) References Cited

U.S. PATENT DOCUMENTS

2013/0157078 A1* 6/2013 Onal ..... C23C 28/3215
428/650
2013/0277622 A1* 10/2013 Oh ..... H01B 1/22
252/513

* cited by examiner

SURFACE ALLOY COATING COMPOSITE MATERIAL USED FOR HIGH TEMPERATURE RESISTANT MATERIAL, COATING AND PREPARATION METHOD THEREOF

CROSS REFERENCE OF RELATED APPLICATION

This is a non-provisional application that claims priority, which was the National Stage of and claims priority to international application number PCT/CN2013/001260, international filing date Oct. 16, 2013, the entire contents of each of which are expressly incorporated herein by reference.

BACKGROUND OF THE PRESENT INVENTION

Field of Invention

The present invention relates to the field of high-temperature protection for metals, and more particularly to a surface alloy coating composite material used for a high temperature resistant materials and a manufacturing method thereof.

Description of Related Arts

The variety of turbines, such as the steam turbine and gas turbine, the heat-side components thereof are typically operated in harsh environments. These harsh environments may cause erosion, high temperature oxidation, hot corrosion damage, and combinations thereof. In addition, the thermal fatigue can cause the components to crack, and after a long run, the components may be further break.

In order to pursue higher power generation efficiency and reduce carbon emission, the operating temperature of the turbine needs to be continually improved. But increasing the operating temperature, the heat resistance of the hot-stage components has to be improved. Thus, a high-temperature alloy component needs to be provided with an anti-oxidation and corrosion resistant coating, thermal diffusion coating or thermal barrier coating. The thermal barrier coatings for high-temperature alloy hot-stage components include metal bonding layers and ceramic insulation layers. U.S. Pat. No. 6,610,420 reported a method for preparing a thermal barrier coating, they firstly coat an anti-oxidation layer containing components A and B on the surface of the high-temperature alloy component by hot spraying, then hot spray a bonding layer containing component C, and finally hot spray a thermal insulation layer made of ceramic material, wherein the components B and C are NiCrAlY alloy, the component A is NiSiCr alloy.

U.S. Pat. No. 5,942,334 reports a MCrAlY anti-oxidation alloy, which can be used for enhancing the binding force of the ceramic layer and preventing the base matrix high-temperature alloy being oxidized. Many ceramic materials are used as the ceramic layer, in particular yttrium oxide or magnesium oxide or other oxide stabilized zirconia. These particular materials are widely used, for they can be coated by plasma spraying, flame spraying and vapor deposition method, and they can still reduce heat radiation. For achieving the purpose of thermal insulation, the thermal barrier coatings must have low thermal conductivity, good combination with the substrate, and can withstand thermal cycling without peeling. A thermal expansion coefficient matching between the coating material and the substrate material is required for anti-thermal cycling peeling. Therefore, the manufacturing method for the thermal barrier coating is usually applying firstly a metal bonding layer on the high-temperature alloy substrate and then applying a thermal insulation layer.

U.S. Pat. Nos. 6,475,647 B2 and 6,475,647B2 report methods for preparing a dense NiCrAlY coating having an anti-coking property. In these methods, the raw material powder for the NiCrAlY coating is heated by plasma transferred arc and blown to the components by argon gas, which is used for preventing the raw powder being oxidized. During the coating process, by controlling the process parameters, molten pool is formed in the surface of the components, the coating having a desired thickness is finally formed in the components. The substrate alloy is melt, which results a diluted coating such that the actual composition of the coating is deviated from the composition of the raw materials, and a transition zone is located between the substrate and the coating, which contains some of the carbides and nitrides dispersed therein. These compounds are generated by carbon and nitrogen high-temperature diffusion in an ethylene furnace and significantly reduce the peeling tendency of the coating. U.S. Patent No. U.S. 2009/0098286A1 reports a method for hot spraying a thermal barrier coating on the heat-side components of a gas turbine.

In a gas turbine, the conventional protective coatings for nickel-based high-temperature alloys can be divided into two types: thermal diffusion aluminide coating and physical vapor deposition or thermal spraying NiCrAlY coating. These coatings have good compatibility with high-temperature alloys. But when the effective component of Al in the coating is lost due to forming of an oxide film and inter-diffusion between the coating and the substrate, the coating will lose effectiveness. In contrast, the inert oxide coating will not lose effectiveness because of the loss of the effective component, but the inert oxide coating is easier to be peeled and failed than the aluminide coating and the NiCrAlY coating, which is caused from the thermal expansion coefficient mismatching between the coating and the substrate.

Under an appropriate condition, enamel-ceramic coating have a good bonding capability with many metals and alloys, which is an important reason that such coatings are widely used. By controlling the crystallization preparation of the base glass, the enamel-ceramic material not only retains ease of use of the enamel coating, and combines some of the special advantages of the ceramic crystals. The enamel-ceramic material has better mechanical strength and heat resistance than the original enamel, and the thermal expansion coefficient of the enamel-ceramic material can be adjusted to match the substrate. It has been proved that $SiO_2$—$Al_2O_3$—ZnO—CaO-based enamel coating has a good protection for intermetallic compound. Alumina-enamel composite coating was also found to be adapted for nickel-based alloys, which has long-term resistance against high temperature oxidation at 1000° C. and hot corrosion at 900° C. However, due to the higher intrinsic brittleness and cracking sensitivity of the enamel material, the enamel or alumina-enamel composite material as a coating material has a weakness, which is weak-resistance for peeling under thermal cycling conditions.

SUMMARY OF THE PRESENT INVENTION

The present invention provides a surface alloy coating composite material used for a high temperature resistant material (components), coating and manufacturing method thereof, wherein the surface alloy coating composite material can improve high temperature oxidation resistance and hot corrosion resistance performance, fracture toughness and thermal shock resistance performance of high temperature alloys. A thermal protective coating made of the material is dense, continuous and smooth, and can form at least partial metallurgical bonding with the high temperature alloy substrate. The surface alloy coating composite material can be applied for various types of turbine components, such as the nickel- or cobalt-based high-temperature alloy vanes and blades of steam turbines and gas turbines, which are operated under the worse working conditions.

In the conventional structure material field, metal-phase or tetragonal zirconia enhancement can significantly increase the fracture toughness of the enamel structure material. The present invention selects the face-centered cubic structure phase having good fracture toughness and high temperatures resistance as the fracture toughness reinforcement phase of the enamel coating, and the face-centered cubic phase may be partially replaced by the rigid reinforcement phase, which can further achieve the effectiveness of improving crack initiation stress force, thermal-shock resistance and the softening point, that is, improving the high temperature stability thereof. Specific technical solution of the invention is as follows:

The present invention particularly provides a surface alloy coating composite material used for a high temperature resistant material, characterized in that:

The surface alloy coating composite material is made of metal alloy powder with a face-centered cubic structure and enamel powder, and a component percentage thereof is as follows: 10-70 wt % is the metal alloy powder, and the remaining is the enamel powder;

The metal alloy powder is at least one type selected from the group consisting of NiCrAlX, NiCrX and NiCoCrAlX, wherein the diameter of the metal alloy powder is 0.1 μm-15 μm, wherein X is at least one type of hafnium, zirconium, a rare earth element and mixed rare earth, and the mixed rare earth is two types or more than two types of rare earth elements that are used together, or a rare earth element and one type or multiple types of Na, K, Ca, Sr and Ba that are used in a combined way;

The surface alloy coating composite material contains: 10 wt %~40 wt % Cr, 0-30 wt % Al, 0.1 wt %~5 wt % X, and the total amount of Cr, Al and X are 25 wt %~45 wt %, wherein the amount of Co is no more than the amount of Ni, wherein Ni is in balance.

The surface alloy coating composite material used for a high temperature resistant material (components) of the present invention, wherein the metal alloy powder is partially replaced by a hardness-reinforcing phase, wherein the hardness-reinforcing phase is at least one selected from the group consisting of alumina, quartz, $ZrO_2$, $Cr_2O_3$, AlN, $Si_3N_4$, BN and SiC, wherein the amount of the hardness-reinforcing phase is no more than 30 wt %.

The surface alloy coating composite material used for a high temperature resistant material (components) of the present invention, wherein the hardness-reinforcing phase is at least one selected from the group consisting of alumina and AlN, and the amount of the hardness-reinforcing phase is 5 wt %-30 wt % of the total amount of the surface alloy coating composite material.

The surface alloy coating composite material used for a high temperature resistant material (components) of the present invention, wherein the metal alloy powder, the enamel powder and the alumina oxide form a triple-component composite coating material, wherein the amount of the alumina is 5 wt %-30 wt % of the amount of the triple-component composite coating material.

The present invention also provides a coating made of the surface alloy coating composite material used for a high temperature resistant material (components), wherein the metal alloy powder or the metal alloy powder and a hardness-reinforcing phase are uniformly distributed in a base matrix made of the enamel powder to form a metal alloy-enamel coating, a metal alloy-enamel-hardness-reinforcing phase coating or a composite coating comprising a metal alloy-enamel coating and a metal alloy-enamel-hardness-reinforcing phase coating provided on the surface of the high-temperature alloy, wherein the softening temperature of the base matrix made of the enamel powder is 600° C.-900° C., wherein the coefficient of thermal extension of the surface alloy coating composite material is $7.0\times10^{-6}K^{-1}$-$12.0\times10^{-6}K^{-1}$.

The thickness of the coating made of the surface alloy coating composite material of the present invention is 10 μm-100 μm.

The method for manufacturing the coating of the present invention is as follows:

(A) mixing homogeneously the metal alloy powder and the enamel powder;

(B) spraying the mixed powder on the surface of the component made of the high-temperature material; and (C) heat-treating the sprayed component made of the high-temperature material under high temperature to form a thermal protection coating on the surface of the component, wherein the thermal protection coating is dense, smooth and continuous, wherein in the thermal protection coating, the metal alloy powder with a face-centered cubic structure is uniformly distributed in a base matrix made of the enamel powder such that an interfacial reaction is capable of be proceed between the metal alloy powder and the surface of the substrate to form a metallurgic bonding there between.

The method for manufacturing the coating of the present invention, wherein the metal alloy powder and the enamel powder are mixed by the dry-milling method, wherein the mixed powder is sprayed on the surface of the component made of the high-temperature material by the compressed air method, and the spraying pressure is 0.2 MPa-0.7 MPa.

The method for manufacturing the coating of the present invention, wherein the high-temperature treatment employs a heating method with variable heat rates: firstly, elevating the temperature up to 150° C.-250° C. by 3° C./min and then keeping the coating coated on the surface of the component under 150° C.-250° C. for 2 h-4 h so as to dehydrate the coating; secondly, elevating the temperature up to 800° C.-1100° C. by at least 20° C./min so as to avoid the crystallization temperature of the enamel and then keeping the coating coated on the surface of the component under 800° C.-1100° C. for 10 min-60 min; lastly, taking the component out of the heating furnace and cooling the component in still ambient air to room temperature.

The method for manufacturing the coating of the present invention, wherein the component is pre-oxidized for 5 min-60 min under 600° C.-1000° C. to form an oxide film on the surface of the component, before the mixed powder is sprayed on the surface of the component, wherein the thickness of the oxide film is 0.2 μm-2 μm.

The surface alloy coating composite material used for a high temperature resistant material (components), according to the present invention, has the following advantages: excellent high-temperature oxidation and hot corrosion resistance, adjustable thermal expansion coefficient, excellent fracture toughness and improved thermal-shock resistance. The coating made of the coating material has the combination of the corrosion resistance advantage of enamel and the toughness advantage of metal alloy. In the coating material, the fracture toughness enhancement phase of the metal alloy further plays an important role in reducing the thermal expansion coefficient difference of the coating/substrate alloy, which is important for improving the thermal shock resistance thereof. The hardness enhancement phase of the coating material improves hardness and strength of the coating, so as to increase crack initiation and propagation stress force level of the coating, thus the thermal shock resistance of the coating is improved.

The manufacturing method of the coating, according to the present invention, employs compressed air spraying method to avoid use of expensive equipments such as plasma spraying or vacuum equipment, which has a good economy.

DETAILED DESCRIPTION OF THE PREFERRED EMBODIMENT

Example 1

Figure 1:
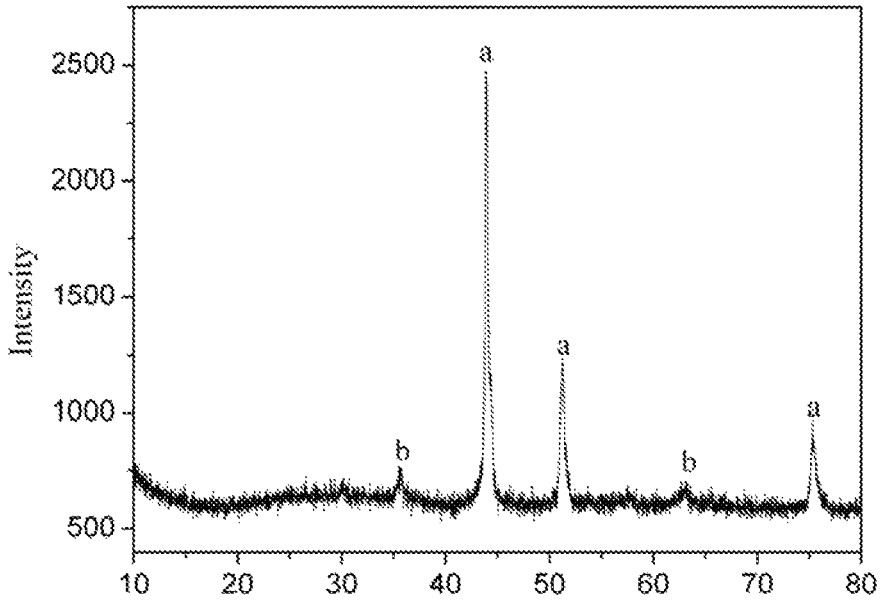
FIG. 1 is a XRD pattern of the coating having a 30 wt % metal alloy fracture toughness enhancement phase and 70 wt % enamel, wherein the coating is under an as-prepared state, wherein a-phase is $\gamma$-Ni/$\gamma'$-$Ni_3Al$, and b phase is $NiCr_2O_4$.

Ball-milling enamel material for 100 h in an agate jar to preparing the enamel powder, wherein the diameter of the enamel powder (particles) is no more than 5 μm. Mixing 140 g enamel powder with 60 g Ni-25Cr-5Al-1Zr-0.5La (wt %) alloy powder, wherein the diameter of the Ni-25Cr-5Al-1Zr-0.5La (wt %) alloy powder (particles) is less than 40 μm, dry-milling for 10 h. Compression moulding the mixed powder for 20 min into powder block under 15 MPa, and then taking the powder block out of the mold, baking the powder block for 2 h at 250° C. to remove moisture. Raising the temperature in 3° C./min, until the temperature is raised up to 590° C. and then raising the temperature in 20° C./min, when the temperature is over the temperature range 800° C.-850° C., setting the sintering temperature at 950° C., and then keeping the temperature at 950° C. for 30 min, and then cooling the powder block in the furnace to room temperature so as to get a face-centered cubic high temperature metal alloy-enamel surface alloy coating composite material.

By the XRD diffraction proof, it is proved that in the coating, the metal alloy is $\gamma$-Ni/$\gamma'$-$Ni_3Al$, which has a face-centered cubic structure, as shown in FIG. 1. A number of physical properties of the composite material is improved, wherein the thermal expansion coefficient of the composite material is $7.0\times10^{-6}K^{-1}$/° C., the fracture toughness of the composite material is 2.0 $MPa\cdot m^{1/2}$, the Young's modulus is 81.1 GPa. In contrast, the thermal expansion coefficient of the pure thermal expansion powder is only $5.7\times10^{-6}K^{-1}$/° C., the fracture toughness is only 1.0 $MPa\cdot m^{1/2}$, the Young's modulus is only 72 GPa. All of this shows that each of the composite material and the corresponding coating has excellent thermal shock resistance, not only because improving of the thermal expansion coefficient reduces the thermal stress force, but the fracture toughness and the Young's modulus are significantly improved also play an important role by improving the material crack initiation and the expansion stress.

Example 2

Ball-milling enamel material for 100 h in an agate jar to preparing the enamel powder, wherein the diameter of the enamel powder (particles) is no more than 5 μm. Mixing 100 g enamel powder with 40 g Ni-25Cr-5Al-1Zr-0.5La (wt %) alloy powder and 60 g alumina powder, wherein the diameter of the Ni-25Cr-5Al-1Zr-0.5La (wt %) alloy powder (particles) is less than 40 μm, the diameter of the alumina powder (particles) is about 7 μm, dry-milling for 10 h. Compression moulding the mixed powder for 20 min into powder block under 15 MPa, and then taking the powder block out of the mold, baking the powder block for 2 h at 250° C. to remove moisture. Raising the temperature in 3° C./min, until the temperature is raised up to 590° C. and then raising the temperature in 20° C./min, when the temperature is over the temperature range 800° C.-850° C., setting the sintering temperature at 950° C., and then keeping the temperature at 950° C. for 30 min, and then cooling the powder block in the furnace to room temperature so as to get a face-centered cubic high temperature metal alloy-enamel-hardness enhancement phase surface alloy coating composite material.

Figure 2:
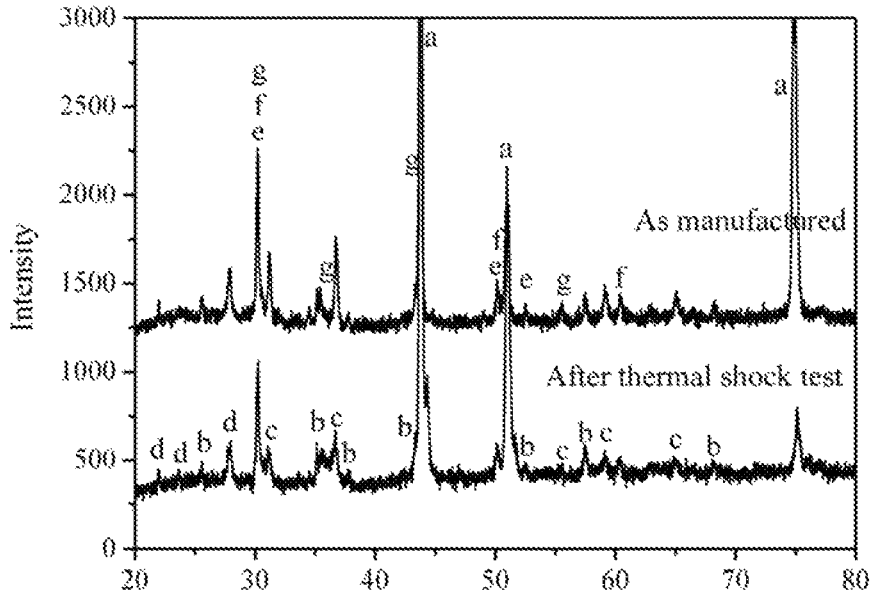
FIG. 2 is a XRD pattern of the coating having a 10 wt % metal alloy fracture toughness enhancement phase, 70 wt % enamel and 20 wt % alumina, wherein the coatings are respectively under as-prepared state and after hot shocking at 1000° C., wherein a: $\gamma/\gamma'$, b: $\alpha$-$Al_2O_3$, c: $ZnAl_2O_4$, d: $Na(AlSi_3O_8)$, e: $K(AlSi_3O_8)$, f: t-$ZrO_2$, g: $NiCr_2O_4$/$ZnCr_2O_4$.

By the XRD diffraction proof, it is proved that in the coating, the metal alloy is $\gamma$-Ni/$\gamma'$-$Ni_3Al$, which has a face-centered cubic structure, and the coating material further contains $\alpha$-$Al_2O_3$ as the hardness enhancement phase thereof, wherein the coating material may further contain $ZnAl_2O_4$, $Na(AlSi_3O_8)$, $K(AlSi_3O_8)$, t-$ZrO_2$ and $NiCr_2O_4$ and $ZnCr_2O_4$ as a reaction phases thereof, which are respectively the hardness enhancement phase, as shown in FIG. 2. The composite material has no crack when is under 1000° C. hot shock condition, which has excellent thermal shock resistance, and after the composite material is treated in the experiment, it still has the above metal alloy phase and the hardness enhancement phase and has excellent structural stability.

Example 3

Ball-milling enamel material for 100 h in an agate jar to preparing the enamel powder, wherein the diameter of the enamel powder (particles) is no more than 5 μm. Preparing respectively 200 g enamel powder, 180 g enamel powder and 20 g Ni-25Cr-5Al-1Zr-0.5La (wt %) alloy powder, 160 g enamel powder and 40 g Ni-25Cr-5Al-1Zr-0.5La (wt %) alloy powder, 140 g enamel powder and 60 g Ni-25Cr-5Al-1Zr-0.5La (wt %) alloy powder, wherein the diameter of the Ni-25Cr-5Al-1Zr-0.5La (wt %) alloy powder (particles) is less than 40 μm. Mixing and Dry-milling respectively for 10 h. Compression moulding respectively the mixed powders for 20 min into powder blocks under 15 MPa, and then taking the powder blocks out of the mold, baking the powder blocks for 2 h at 250° C. to remove moisture. Raising the temperature in 3° C./min, until the temperature is raised up to 590° C. and then raising the temperature in 20° C./min, when the temperature is over the temperature range 800° C.-850° C., setting the sintering temperature at 950° C., and then keeping the temperature at 950° C. for 30 min, and then cooling the powder block in the furnace to room temperature so as to get a pure enamel material and three face-centered cubic high temperature metal alloy-enamel composite material.

Figure 3:
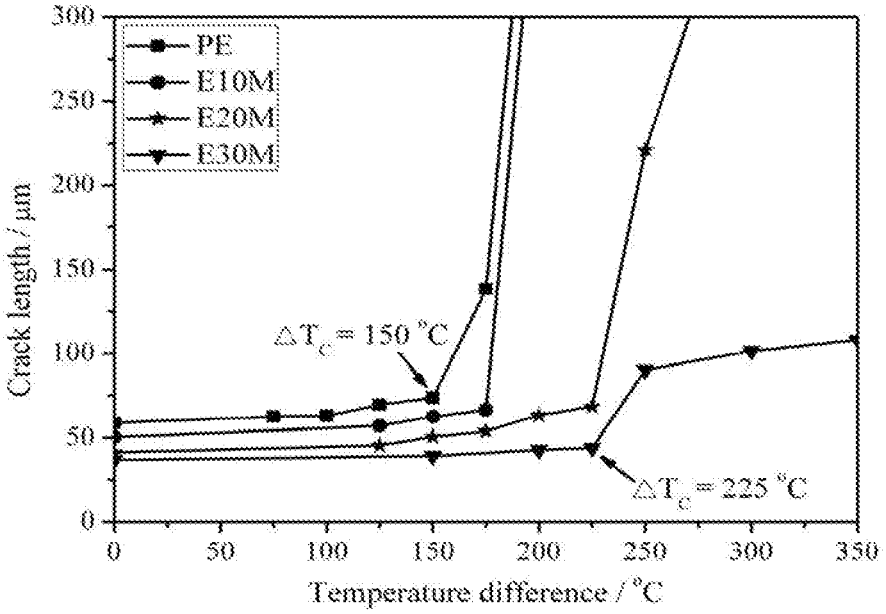
FIG. 3 shows the shock resistance of the enamel-NiCrLa material (indentation-water quenching method), wherein PE, E10M, E20M, E30M respectively represent the material containing 0, 10, 20, 30 wt % metal alloy particles.

Testing the samples by the indentation-water quenching test (as shown in FIG. 3), that is, which uses micro-hardness diamond to indenter in the polished surfaces of the samples to prefabricate 1 μm-4 μm micro-cracks therein, then heating the samples up to the test temperature, thermal insulating for 30 min, rapid cooling in deionized water at 25° C., observing crack propagation. The test results of the indentation-water quenching test show that the crack growth curve moves to the right following the improvement of the content of the face-centered cubic metal alloy particles in the material, that is, with the alloy particles content is increased, the toughness of the material is significantly enhanced. When the content of the metal phase reaches 30 wt %, the crack don't increase infinitely with the raised temperature difference of insulating temperature-water quenching temperature while stop extending when the crack grows a maximum size of 10 μm. After the hot shock tests are accomplished, the mechanism of crack deflection, crack bridging and alloys-enamel interface cracking, all of this shows that the face-centered cubic nickel-based alloy particles having high toughness have good wettability and binding force with the enamel base matrix thereof, because of its rare earth-containing, which plays an important role in improving the thermal shock resistance.

Example 4

Ball-milling enamel material for 100 h in an agate jar to preparing the enamel powder, wherein the diameter of the enamel powder (particles) is no more than 5 μm. Preparing respectively 160 g enamel powder and 40 g Ni-25Cr-5Al-1Zr-0.5La (wt %) alloy powder, 140 g enamel powder and 60 g Ni-25Cr-5Al-1Zr-0.5La (wt %) alloy powder, 140 g enamel powder, 20 g Ni-25Cr-5Al-1Zr-0.5La (wt %) alloy powder and 40 g alumina powder, wherein the diameter of the alumina powder (particles) is about 7 μm. Dry-milling each powder mixture for 10 h. Preparing slurries by adding ethyl alcohol into the above-prepared three types of powder mixtures. Selecting the nickel-based high temperature alloy K38G as the substrate, wherein the chemical compositions are as shown in Table 1 and the thermal expansion coefficient is $18\times10^{-6}K^{-1}$.

Figure 4:
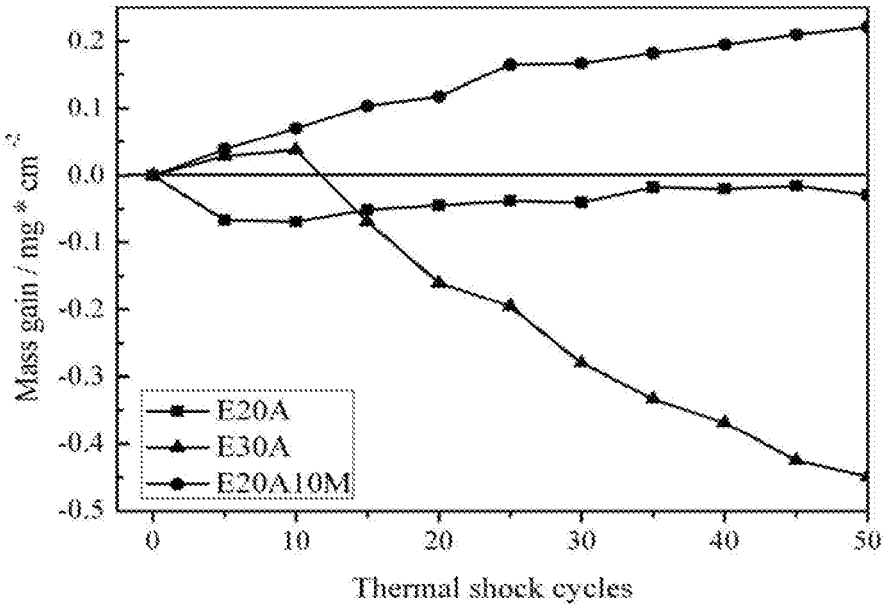
FIG. 4 shows hot-shock weight loss curves of several enamel-metal materials. E20A and E30A are respectively the materials containing 20 and 30 wt % alumina hardness enhancement phase, and E20A10M is a material containing 20 wt % alumina hardness enhancement phase and 10 wt % metal alloy fracture toughness enhancement phase.

Pre-oxidizing the component for 5 min at 850° C. to form a thin oxide film on the surface of the component before the slurries are sprayed on the substrates, wherein the oxide film is amorphous to be in favor of combining with the amorphous enamel. Preparing the three mixed powders with ethyl alcohol into slurries, and making the powders be distributed uniformly only by ultrasonic vibration, without any dispersing agent; at room temperature atmosphere, spraying the slurries on the sheet components made of high-temperature alloy K38G, wherein the size of the sheet component is 100 mm×20 mm×2 mm, then baking the components for 15 min at 250° C., and finally treating for 10 min at 950° C. to form a coating having a thickness of about 30 μm. Each cycle of the thermal shocking test is performed by heating the components for 30 min at 1000° C. and then quenching the components into deionized water. The test results of quality change curves of the components is shown in FIG. 4, which shows that the coatings, especially the coating made of alloy-enamel-aluminum oxide material, has excellent thermal shock resistance without any peeling. The peeling situations of the other coatings are also much better than the pure enamel coating. 50% of the pure enamel coating surface is peeled off just under the as-prepared status, and the remaining of the coating is completely peeled off after only 1 cycle of thermal shocking test.

TABLE 1

Chemical compositions of high temperature alloy K38G (wt %)

| Ni | C | Cr | Al | Co | W | B | Ti | Mo | Nb | Ta | P |
|---|---|---|---|---|---|---|---|---|---|---|---|
| Bal. | 0.17 | 16.0 | 4.0 | 8.5 | 2.0 | 0.01 | 3.8 | 1.7 | 0.7 | 1.7 | <0.01 |

Example 5

Figure 5:
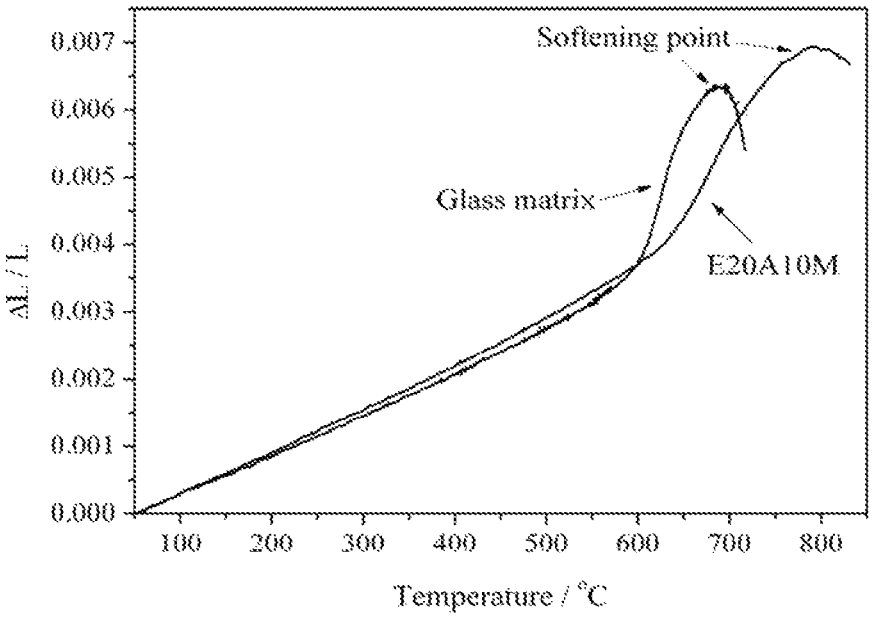
FIG. 5 shows thermal expansion curves of pure enamel material and enamel-alumina-metal alloy material, wherein E20A10M is a material containing 20 wt % alumina hardness enhancement phase and 10 wt % metal alloy fracture toughness enhancement phase.
Figure 6:
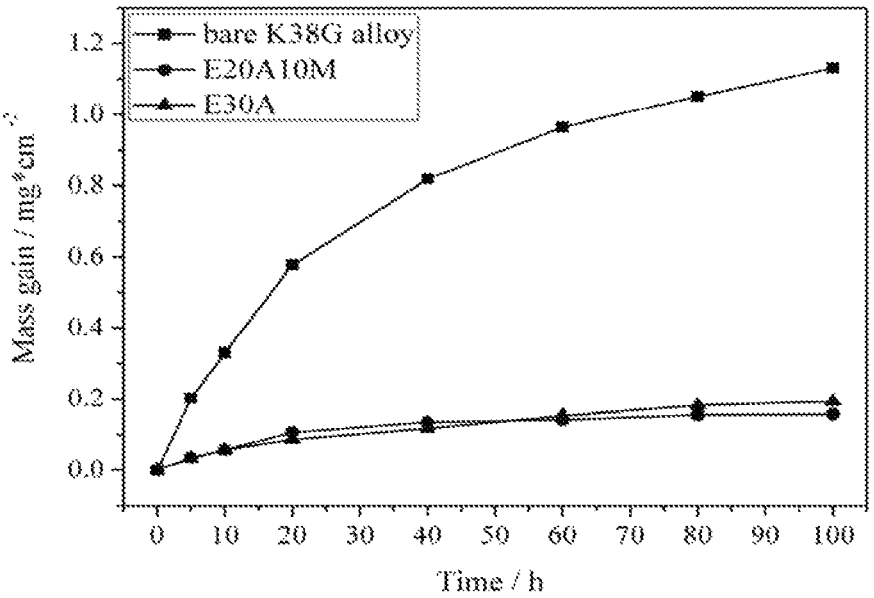
FIG. 6 shows 1000° C. cyclic oxidation curves of alumina-enamel coating and metal alloy-enamel-alumina coating; wherein E30A is a material containing 30 wt % alumina hardness enhancement phase, E20A10M is a material containing 20 wt % alumina hardness enhancement phase and 10 wt % metal alloy fracture toughness enhancement phase.

Preparing respectively 180 g enamel powder, 20 g Ni-25Cr-5Al-1Zr-0.5La (wt %) alloy powder and 60 g alumina powder, wherein the diameter of the Ni-25Cr-5Al-1Zr-0.5La (wt %) alloy powder (particles) is less than 40 μm, the diameter of the alumina powder (particles) is about 7 μm, then dry-milling the powder mixture for 10 h. And then preparing composite material according to the above manufacturing method described in Example 1. The thermal expansion curve of the composite material is as shown in FIG. 5. Comparing with the pure enamel material, the softening point is elevated up 120° C.

Example 6

Preparing respectively the $Al_2O_3$ (30 wt %)-enamel (70 wt %) composite material coating, the Ni-20Co-25Cr-5Al-0.3Ce-0.5La-0.2Dy (10 wt %)-enamel (70 wt %)-$Al_2O_3$ (20 wt %) composite material coating, according to the preparing method described in Example 4, then cyclic oxidizing the samples at 1000° C., and in a cyclic oxidizing, heating for 60 min at 1000° C. and air-cooling for 15 min. The test of 100 cycles is carried out. The test results show that the two coatings have equivalent high temperature oxidation resistance and do not appear coating peeling, and the oxidation resistance of K38G alloy is significantly improved.

Example 7

Figure 7:
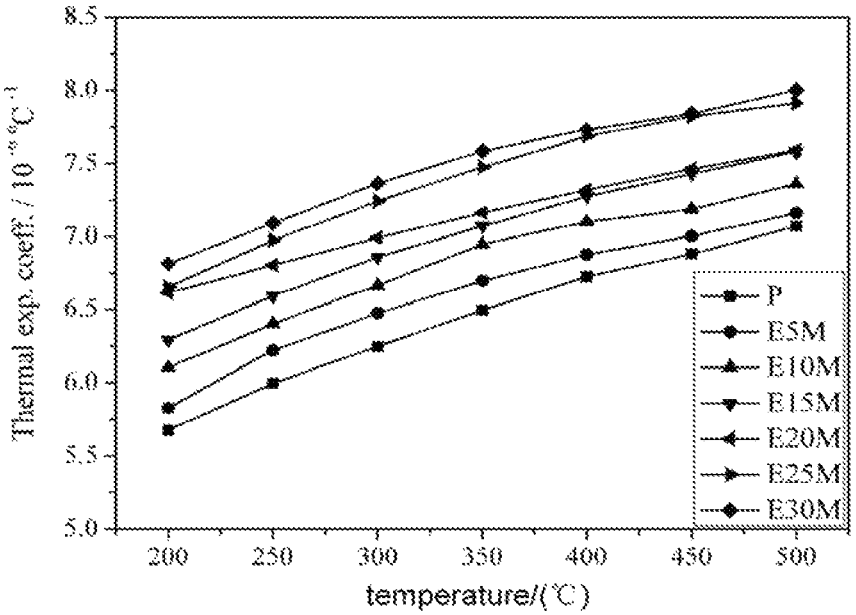
FIG. 7 shows thermal expansion coefficient curves of various enamel-metal alloy materials, wherein P, E5M, E10M, E15M, E20M, E25M and E30M respectively illustrate that the material contains 0, 5, 10, 15, 20, 25, 30 wt % metal alloy fracture toughness enhancement phase.

Preparing respectively the pure enamel composite coating material, other six Ni-25Cr-0.3Ce alloy-enamel composite coating materials, according to the preparing method described in Example 1, wherein the contents of the alloy are respectively 5%, 10%, 15%, 20%, 25%, 30% of the total amounts of the composite materials. The thermal expansion coefficient curves of the samples are measured (shown in FIG. 7). The test results show that the improved metal alloy content of the composite material benefits increasing the thermal expansion coefficient.

Example 8

Preparing respectively multi-component alloy coatings on a single crystal high temperature alloy Rene N5 substrate and a model high temperature alloy Ni-20Al-10Mo (wt %), according to the preparing method described in Example 4, the specific compositions of the coatings are shown in described in Table 2. The cyclic oxidizing properties of the coatings are measured at 1050° C. In a cyclic oxidizing, heating for 60 min at 1050° C. and air-cooling for 15 min. The test of 100 cycles is carried out. The cyclic weight increase (the peeling amount included) and the peeling are shown in Table 3.

TABLE 2

Compositions of the enamel composite coatings

| | Alloy phase | | Hard particles | | Enamel |
|---|---|---|---|---|---|
| No. | Composition (wt %) | Percentage (wt %) | formula | Percentage (wt %) | Percentage (wt %) |
| 1 | Ni—20.5Cr—0.1La—4.4Sr | 10 | — | — | 90 |
| 2 | Ni—25Cr—6Al—0.5Hf—0.5K | 30 | — | — | 70 |
| 3 | Ni—20Co—40.5Cr—4Al—0.5Hf | 70 | — | — | 30 |
| 4 | Ni—20Co—10Cr—5Al—0.5Hf—0.5K | 10 | $ZrO_2$ | 25 | 90 |
| 5 | Ni—20Cr—12Al—0.5Yb | 10 | $SiO_2$ | 20 | 70 |
| 6 | Ni—25Cr—0.5HF—0.2Tb | 40 | $Cr_2O_3$ | 30 | 30 |
| 7 | Ni—22Co—20.5Cr—5Al—0.5Hf | 4 | $Si_3N_4$ | 6 | 90 |
| 8 | Ni—30Cr—8Al—0.5Gd—0.1N | 20 | AlN | 10 | 70 |
| 9 | Ni—22Co—40.5Cr—4Al—0.5Hf | 60 | BN | 10 | 30 |
| 10 | Ni—20.5Cr—0.1La—4.4Sr | 20 | $SiO_2$ | 5 | 60 |
| | | | $Cr_2O_3$ | 15 | |
| 11 | Ni—20.5Cr—0.1La—4.4Sr | 10 | $Al_2O_3$ | 30 | 30 |
| | Ni—20Co—20.5Cr—6Al—0.1La—0.4Dy | 20 | AlN | 10 | |
| 12 | Ni—25Cr—6Al—0.5Hf | 10 | $Al_2O_3$ | 10 | 60 |
| | Ni—20Co—20.5Cr—6Al—0.1La—0.4DHf | 15 | $ZrO_2$ | 5 | |
| 13 | Ni—25Cr—6Al—0.5Hf | 30 | — | — | 30 |
| | Ni—20Co—20.5Cr—6Al—0.1La—0.4Dy | 40 | | | |
| 14 | — | — | $ZrO_2$ | 20 | 70 |
| | | | $Al_2O_3$ | 10 | |

TABLE 3

Depiction of the composite coatings and results after cyclic oxidation

| Substrate | No. of coating | Thickness of coating (μm) | Weight change (mg/cm$^2$) | Spallatin condition |
|---|---|---|---|---|
| Rene N5 | 1 | 25 | 0.8 | no |
| Ni—20Al—10Mo | 1 | 25 | 0.8 | no |
| Rene N5 | 2 | 25 | 0.4 | no |
| Ni—20Al—10Mo | 2 | 25 | 0.4 | no |
| Rene N5 | 3 | 25 | 0.6 | no |
| Ni—20Al—10Mo | 3 | 25 | 0.6 | no |
| Rene N5 | 4 | 25 | 0.7 | no |
| Ni—20Al—10Mo | 4 | 25 | 0.6 | no |
| Rene N5 | 5 | 25 | 0.3 | no |
| Ni—20Al—10Mo | 5 | 25 | 0.3 | no |
| Rene N5 | 6 | 25 | 0.4 | no |
| Ni—20Al—10Mo | 6 | 25 | 0.5 | no |
| Rene N5 | 7 | 25 | 0.9 | no |
| Ni—20Al—10Mo | 7 | 25 | 0.9 | no |

TABLE 3-continued

Depiction of the composite coatings and results after cyclic oxidation

| Substrate | No. of coating | Thickness of coating (μm) | Weight change (mg/cm$^2$) | Spallatin condition |
|---|---|---|---|---|
| Rene N5 | 8 | 25 | 0.4 | no |
| Ni—20Al—10Mo | 8 | 25 | 0.4 | no |
| Rene N5 | 9 | 25 | 0.6 | no |
| Ni—20Al—10Mo | 9 | 25 | 0.6 | no |
| Rene N5 | 10 | 25 | 0.3 | no |
| Ni—20Al—10Mo | 10 | 25 | 0.3 | no |
| Rene N5 | 11 | 25 | 0.4 | no |
| Ni—20Al—10Mo | 11 | 25 | 0.4 | no |
| Rene N5 | 12 | 25 | 0.3 | no |
| Ni—20Al—10Mo | 12 | 25 | 0.3 | no |
| Rene N5 | 13 | 25 | 0.5 | no |
| Ni—20Al—10Mo | 13 | 25 | 0.5 | no |
| Rene N5 | 14 | 15 | 0.8 | Spall at corners after 15 cycles |
| Ni—20Al—10Mo | 14 | 15 | −3 | Test ceased due to ⅔ spallation after 10 cycles |

TABLE 3-continued

Depiction of the composite coatings and results after cyclic oxidation

| Substrate | No. of coating | Thickness of coating (μm) | Weight change (mg/cm$^2$) | Spallatin condition |
|---|---|---|---|---|
| Rene N5 | 13 | 10 | 0.2 | no |
| | 14 | 25 | | |
| Ni—20Al—10Mo | 13 | 10 | 0.2 | no |
| | 14 | 25 | | |
| Rene N5 | 13 | 30 | 0.1 | no |
| | 12 | 30 | | |
| | 14 | 40 | | |
| Ni—20Al—10Mo | 13 | 30 | 0.1 | no |
| | 12 | 30 | | |
| | 14 | 40 | | |

The above examples are only used for illustrating the technical concept and features of the present invent. The purpose is to enable those skilled in the art to understand the content of the present invent and implement accordingly, but not to limit the scope of the present invent. It will be understood that modifications and alternatives without departing from the scope and spirit of the invention will be within the scopes of the following claims of the invention.

What is claimed is:

1. A method for manufacturing a coating, wherein the coating is made of a surface alloy coating composite material, wherein the surface alloy coating composite material is used for a thermal resistant material, wherein the surface alloy coating composite material is made of metal alloy powder with a face-centered cubic structure and enamel powder, and a component percentage thereof is as follows: 10-70 wt % is the metal alloy powder, and the remaining is the enamel powder; the metal alloy powder is at least one type selected from the group consisting of NiCrAlX, NiCrX and NiCoCrAlX, wherein the diameter of the metal alloy powder is 0.1 μm-15 μm, wherein X is at least one type of hafnium, zirconium, a rare earth element and mixed rare earth, and the mixed rare earth is two types or more than two types of rare earth elements that are used together, or a rare earth element and one type or multiple types of Na, K, Ca, Sr and Ba that are used in a combined way; the surface alloy coating composite material contains: 10 wt %~40 wt % Cr, 0-30 wt % Al, 0.1 wt %~5 wt % X, and the total amount of Cr, Al and X are 25 wt %~45 wt %, wherein the amount of Co is no more than the amount of Ni, wherein the metal alloy powder or the metal alloy powder and a hardness-reinforcing phase are uniformly distributed in a base matrix made of the enamel powder to define a metal alloy-enamel coating, a metal alloy-enamel-hardness-reinforcing phase coating or a composite coating comprising a metal alloy-enamel coating and a metal alloy-enamel-hardness-reinforcing phase coating provided on the surface of an alloy, wherein the softening temperature of the base matrix made of the enamel powder is 600° C.-900° C., wherein the coefficient of thermal extension of the surface alloy coating composite material is $7.0\times10^{-6}K^{-1}$-$12.0\times10^{-6}K^{-1}$, wherein the method for manufacturing the coating comprises the steps of:

(A) mixing evenly the metal alloy powder and the enamel powder;

(B) spray-coating the mixed powder on the surface of a component made of a material; and (C) treating the sprayed component made of the material under high temperature to form a thermal protection coating on the surface of the component, wherein the thermal protection coating is dense, smooth and continuous, wherein in the thermal protection coating, the metal alloy powder with a face-centered cubic structure is uniformly distributed in a substrate made of the enamel powder such that an interfacial reaction is capable of being processed between the metal alloy powder and the surface of the substrate to form a metallurgic bonding there between, wherein in the step (C), the treating of the sprayed component made of the material under high temperature employs a heating method with variable heating rates: firstly, elevating the temperature up to 150° C.-250° C. by 3° C./min and then keeping the coated component under 150° C.-250° C. for 2 h-4 h so as to dehydrate the coating; secondly, elevating the temperature up to 800° C.-1100° C. by at least 20° C./min so as to avoid the crystallization temperature of the enamel and then keeping the coated component under 800° C.-1100° C. for 10 min-60 min; lastly, taking the component out of the heating furnace and cooling the component in still ambient air to room temperature.

2. A method for manufacturing a coating, wherein the coating is made of a surface alloy coating composite material, wherein the surface alloy coating composite material is used for a thermal resistant material, wherein the surface alloy coating composite material is made of metal alloy powder with a face-centered cubic structure and enamel powder, and a component percentage thereof is as follows: 10-70 wt % is the metal alloy powder, and the remaining is the enamel powder; the metal alloy powder is at least one type selected from the group consisting of NiCrAlX, NiCrX and NiCoCrAlX, wherein the diameter of the metal alloy powder is 0.1 μm-15 μm, wherein X is at least one type of hafnium, zirconium, a rare earth element and mixed rare earth, and the mixed rare earth is two types or more than two types of rare earth elements that are used together, or a rare earth element and one type or multiple types of Na, K, Ca, Sr and Ba that are used in a combined way; the surface alloy coating composite material contains: 10 wt %~40 wt % Cr, 0-30 wt % Al, 0.1 wt %~5 wt % X, and the total amount of Cr, Al and X are 25 wt %~45 wt %, wherein the amount of Co is no more than the amount of Ni, wherein the metal alloy powder or the metal alloy powder and a hardness-reinforcing phase are uniformly distributed in a base matrix made of the enamel powder to define a metal alloy-enamel coating, a metal alloy-enamel-hardness-reinforcing phase coating or a composite coating comprising a metal alloy-enamel coating and a metal alloy-enamel-hardness-reinforcing phase coating provided on the surface of an alloy, wherein the softening temperature of the base matrix made of the enamel powder is 600° C.-900° C., wherein the coefficient of thermal extension of the surface alloy coating composite material is $7.0\times10^{-6}K^{-1}$-$12.0\times10^{-6}K^{-1}$, wherein the method for manufacturing the coating comprises the steps of:

(A) mixing evenly the metal alloy powder and the enamel powder;

(B) spray-coating the mixed powder on the surface of a component made of a material; and (C) treating the sprayed component made of the material under high temperature to form a thermal protection coating on the surface of the component, wherein the thermal protection coating is dense, smooth and continuous, wherein in the thermal protection coating, the metal alloy powder with a face-centered cubic structure is uniformly distributed in a substrate made of the enamel powder such that an interfacial reaction is capable of being processed between the metal alloy powder and the surface of the substrate to form a metallurgic bonding there between, wherein the component is pre-oxidized for 5 min-60 min under 600° C.-1000° C. in advance to form an oxide film on the surface of the component, before the mixed powder is sprayed on the surface of the component, wherein the thickness of the oxide film is 0.2 μm-2 μm.

3. A method for manufacturing the coating, wherein the coating is made of a surface alloy coating composite material, wherein the surface alloy coating composite material is used for a thermal resistant material, wherein the surface alloy coating composite material is made of metal alloy powder with a face-centered cubic structure and enamel powder, and a component percentage thereof is as follows: 10-70 wt % is the metal alloy powder, and the remaining is the enamel powder; the metal alloy powder is at least one type selected from the group consisting of NiCrAlX, NiCrX and NiCoCrAlX, wherein the diameter of the metal alloy powder is 0.1 μm-15 μm, wherein X is at least one type of hafnium, zirconium, a rare earth element and mixed rare earth, and the mixed rare earth is two types or more than two types of rare earth elements that are used together, or a rare earth element and one type or multiple types of Na, K, Ca, Sr and Ba that are used in a combined way; the surface alloy coating composite material contains: 10 wt %~40 wt % Cr, 0-30 wt % Al, 0.1 wt %~5 wt % X, and the total amount of Cr, Al and X are 25 wt %~45 wt %, wherein the amount of Co is no more than the amount of Ni, wherein the face-centered cubic structure phase is partially replaced by a hardness-reinforcing phase, wherein the metal alloy powder is partially substituted by least one compound selected from the group consisting of alumina, quartz, $ZrO_2$, $Cr_2O_3$, AlN, $Si_3N_4$, BN and SiC, wherein the amount of the substituted compound is no more than 30 wt %, wherein the metal alloy powder or the metal alloy powder and a hardness-reinforcing phase are uniformly distributed in a base matrix made of the enamel powder to define a metal alloy-enamel coating, a metal alloy-enamel-hardness-reinforcing phase coating or a composite coating comprising a metal alloy-enamel coating and a metal alloy-enamel-hardness-reinforcing phase coating provided on the surface of an alloy, wherein the softening temperature of the base matrix made of the enamel powder is 600° C.-900° C., wherein the coefficient of thermal extension of the surface alloy coating composite material is $7.0\times10^{-6}K^{-1}$-$12.0\times10^{-6}K^{-1}$, wherein the method of manufacturing the coating comprises the steps of:

(A) mixing evenly the metal alloy powder and the enamel powder;

(B) spray-coating the mixed powder on the surface of a component made of a material; and (C) treating the sprayed component made of the material under high temperature to form a thermal protection coating on the surface of the component, wherein the thermal protection coating is dense, smooth and continuous, wherein in the thermal protection coating, the metal alloy powder with a face-centered cubic structure is uniformly distributed in a substrate made of the enamel powder such that an interfacial reaction is capable of being processed between the metal alloy powder and the surface of the substrate to form a metallurgic bonding therebetween, wherein in the step (C), the treating of the sprayed component made of the material under high temperature employs a heating method with variable heating rates: firstly, elevating the temperature up to 150° C.-250° C. by 3° C./min and then keeping the coated component under 150° C.-250° C. for 2 h-4 h so as to dehydrate the coating; secondly, elevating the temperature up to 800° C.-1100° C. by at least 20° C./min so as to avoid the crystallization temperature of the enamel and then keeping the coated component under 800° C.-1100° C. for 10 min-60 min; lastly, taking the component out of the heating furnace and cooling the component in still ambient air to room temperature.

4. A method for manufacturing the coating, wherein the coating is made of a surface alloy coating composite material, wherein the surface alloy coating composite material is used for a thermal resistant material, wherein the surface alloy coating composite material is made of metal alloy powder with a face-centered cubic structure and enamel powder, and a component percentage thereof is as follows: 10-70 wt % is the metal alloy powder, and the remaining is the enamel powder; the metal alloy powder is at least one type selected from the group consisting of NiCrAlX, NiCrX and NiCoCrAlX, wherein the diameter of the metal alloy powder is 0.1 μm-15 μm, wherein X is at least one type of hafnium, zirconium, a rare earth element and mixed rare earth, and the mixed rare earth is two types or more than two types of rare earth elements that are used together, or a rare earth element and one type or multiple types of Na, K, Ca, Sr and Ba that are used in a combined way; the surface alloy coating composite material contains: 10 wt %~40 wt % Cr, 0-30 wt % Al, 0.1 wt %~5 wt % X, and the total amount of Cr, Al and X are 25 wt %~45 wt %, wherein the amount of Co is no more than the amount of Ni, wherein the face-centered cubic structure phase is partially replaced by a hardness-reinforcing phase, wherein the metal alloy powder is partially substituted by least one compound selected from the group consisting of alumina, quartz, $ZrO_2$, $Cr_2O_3$, AlN, $Si_3N_4$, BN and SiC, wherein the amount of the substituted compound is no more than 30 wt %, wherein the metal alloy powder or the metal alloy powder and a hardness-reinforcing phase are uniformly distributed in a base matrix made of the enamel powder to define a metal alloy-enamel coating, a metal alloy-enamel-hardness-reinforcing phase coating or a composite coating comprising a metal alloy-enamel coating and a metal alloy-enamel-hardness-reinforcing phase coating provided on the surface of an alloy, wherein the softening temperature of the base matrix made of the enamel powder is 600° C.-900° C., wherein the coefficient of thermal extension of the surface alloy coating composite material is $7.0\times10^{-6}K^{-1}$-$12.0\times10^{-6}K^{-1}$, wherein the method of manufacturing the coating comprises the steps of:

(A) mixing evenly the metal alloy powder and the enamel powder;

(B) spray-coating the mixed powder on the surface of a component made of a material; and (C) treating the sprayed component made of the material under high temperature to form a thermal protection coating on the surface of the component, wherein the thermal protection coating is dense, smooth and continuous, wherein in the thermal protection coating, the metal alloy powder with a face-centered cubic structure is uniformly distributed in a substrate made of the enamel powder such that an interfacial reaction is capable of being processed between the metal alloy powder and the surface of the substrate to form a metallurgic bonding therebetween, wherein the component is pre-oxidized for 5 min-60 min under 600° C.-1000° C. in advance to form an oxide film on the surface of the component, before the mixed powder is sprayed on the surface of the component, wherein the thickness of the oxide film is 0.2 μm-2 μm.

* * * * *